US012251747B2

(12) United States Patent
Shiotani

(10) Patent No.: US 12,251,747 B2
(45) Date of Patent: Mar. 18, 2025

(54) MANUFACTURING METHOD OF PLATE MEMBER

(71) Applicant: DAIWA CAN COMPANY, Chiyoda-ku (JP)

(72) Inventor: Masahiro Shiotani, Sagamihara (JP)

(73) Assignee: DAIWA CAN COMPANY, Chiyoda-ku (JP)

( * ) Notice: Subject to any disclaimer, the term of this patent is extended or adjusted under 35 U.S.C. 154(b) by 222 days.

(21) Appl. No.: 17/907,369

(22) PCT Filed: Jan. 29, 2021

(86) PCT No.: PCT/JP2021/003145
§ 371 (c)(1),
(2) Date: Sep. 26, 2022

(87) PCT Pub. No.: WO2021/192604
PCT Pub. Date: Sep. 30, 2021

(65) Prior Publication Data

US 2023/0123829 A1 Apr. 20, 2023

(30) Foreign Application Priority Data

Mar. 27, 2020 (JP) ..... 2020-058741

(51) Int. Cl.
*B21D 22/02* (2006.01)
*B21D 28/04* (2006.01)
(Continued)

(52) U.S. Cl.
CPC ..... *B21D 22/02* (2013.01); *B21D 28/26* (2013.01)

(58) Field of Classification Search
CPC ..... B21D 22/02; B21D 28/26; B21D 28/265; B21D 28/04; B21D 28/06; B21D 37/08; B21D 43/05
See application file for complete search history.

(56) References Cited

U.S. PATENT DOCUMENTS

2008/0223105 A1 9/2008 Ichikawa et al.
2019/0009324 A1* 1/2019 Hashimoto ..... B21D 28/02

FOREIGN PATENT DOCUMENTS

JP 3-86333 A 4/1991
JP H0386333 A * 4/1991
(Continued)

OTHER PUBLICATIONS

English translate (JP2000140953A), retrieved date Jun. 8, 2024.*
(Continued)

*Primary Examiner* — Mohammed S. Alawadi
(74) *Attorney, Agent, or Firm* — Oblon, McClelland, Maier & Neustadt, L.L.P.

(57) ABSTRACT

A manufacturing method of a plate member, in which a strip material can be positioned with respect to a die all through stamping operations using a pilot hole formed in an initial phase of the stamping operations. The plate member is manufactured by a press machine in which a progressive stamping die having a plurality of stations is placed. The manufacturing method comprises: forming an oval pilot hole 14 in an uncoiled strip 13; and stamping the uncoiled strip 13 by a plurality of operations while bringing a pilot pin 17 into contact with an inner edge of the pilot hole 14 at the operation before the pilot hole 14 is displaced, and at the operation after the pilot hole 14 is displaced.

9 Claims, 6 Drawing Sheets

(51) Int. Cl.

| | |
|---|---|
| ***B21D 28/06*** | (2006.01) |
| ***B21D 28/26*** | (2006.01) |
| ***B21D 37/08*** | (2006.01) |
| ***B21D 43/05*** | (2006.01) |

(56) References Cited

FOREIGN PATENT DOCUMENTS

| | | | | |
|---|---|---|---|---|
| JP | 3-230824 | A | | 10/1991 |
| JP | 2000140953 | A | * | 5/2000 |
| JP | 2008-221284 | A | | 9/2008 |
| JP | 2017-087246 | A | | 5/2017 |
| JP | 2019-47689 | A | | 3/2019 |

OTHER PUBLICATIONS

English translate (JPH0386333A), retrieved date Jun. 8, 2024.*
International Search Report issued Apr. 6, 2021 in PCT/JP2021/003145 filed on Jan. 29, 2021, 3 pages.

* cited by examiner

MANUFACTURING METHOD OF PLATE MEMBER

TECHNICAL FIELD

The present invention relates to a method of manufacturing a plurality of plate members sequentially by feeding a strip material at a given pitch to a press machine having a stamping function including bending and shearing functions thereby shaping the strip material gradually into a desired shape.

BACKGROUND ART

A progressive stamping method to process a coiled strip material into a plurality of plate members by drawing, bending, shearing, compressing, etc. is known in the art. In the stamping method of this kind, a portion of the strip material which has been stamped at a predetermined step is conveyed to the subsequent step to be further stamped. In order to position the portions of the strip material to be stamped with respect to stations of a progressive die, generally, pilot holes are formed in the strip material at the same intervals as the pitch which the strip material are conveyed. On the other hand, pilot pins are arranged on each station to be fitted into the pilot holes.

However, when compressing or drawing the strip material, the position of the pilot hole may be displaced with respect to the pilot pin due to plastic flow in materials composing the strip material. Therefore, the positioning of the portions of the strip material to be stamped may be disturbed in the subsequent steps. Japanese Patent Laid-Open No. 2017-87246 describes a stamping method to avoid such disturbance of the positioning caused by the displacement of the pilot holes. According to the teachings of Japanese Patent Laid-Open No. 2017-87246, in addition to stamping operations, pilot holes are formed in the workpieces at each step to insert pilot pins disposed on the die in the subsequent steps.

SUMMARY OF INVENTION

Technical Problem to be Solved by the Invention

According to the progressive stamping method, the pilot holes are normally formed in a predetermined site of the strip material other than a site to be processed into a desired shape. That is, the portions of the strip material at which the pilot holes are formed will be punched away and scrapped without being processed into a final product. Therefore, in the stamping method according to Japanese Patent Laid-Open No. 2017-87246, not only the areas to stamp but also the areas to form the pilot holes in the workpieces have to be ensured. Moreover, because the stamping method according to Japanese Patent Laid-Open No. 2017-87246 requires a great number of the pilot holes and large areas in the workpieces for forming the pilot holes, a production yield may be decreased, and manufacturing costs may thus be increased. Furthermore, punches are required to be formed on the die at each step so as to form the pilot holes, and may thus increase the size of the die. In addition, load caused by the punches to form the pilot holes may increase energy loss.

The present invention has been conceived noting the above-explained technical problems, and it is therefore an object of the present invention to provide a manufacturing method of a plate member, in which a strip material can be positioned with respect to a die all through stamping operations using a pilot hole formed in an initial phase of the stamping operations.

Means for Solving the Problem

According to the present invention, there is provided a method of manufacturing plate members continuously by feeding a strip material at a given pitch to a press machine in which a progressive stamping die having a plurality of stations is placed, and stamping the strip material at each of the stations of the die. In order to achieve the above-explained objective, the manufacturing method comprises: obtaining a displacement of a pilot hole pierced in the strip material as might be caused by stamping the strip material; determining a shape of the pilot hole or a position of a pilot pin of the die such that the pilot pin is inserted into the pilot hole after being displaced while being brought into contact with an inner edge of the displaced pilot hole; piercing the pilot hole having the determined shape in the strip material, or adjusting the position of the pilot pin to the determined position; and stamping the strip material by a plurality of operations while bringing the pilot pin into contact with the inner edge of the pilot hole at the operation before the pilot hole is displaced, and at the operation after the pilot hole is displaced.

According to the present invention, the displacement of the pilot hole may be obtained by stamping the strip material by the plurality of operations in advance.

According to the present invention, any of the operations may include a compressing operation to depress the strip material, or a shearing operation to pierce a desired portion of the strip material, and the strip material may be positioned by bringing a plug arranged in the press machine into contact with a side wall of a recess formed by compressing the strip material, or bringing the plug into contact with an inner edge of a through hole formed by piercing the strip material.

According to the present invention, any of the operations may be the compressing operation, and the press machine may comprise a buffer member that absorbs a pushing force of the plug toward a bottom of the recess.

According to the present invention, the buffer member may be attached to an end face of the plug opposed to the bottom of the recess.

According to the present invention, the buffer member may be arranged between the plug and any of an upper die and a lower die between which the strip material is interposed.

Advantageous Effects of Invention

According to the present invention, the strip material is fed to the press machine at a given pitch to be stamped by a plurality of operations. A displacement of a pilot hole as might be caused by stamping the strip material is obtained in advance, and the shape of the pilot hole or the position of the pilot pin is determined such that the pilot pin inserted into the pilot hole comes into contact with the inner edge of the pilot hole during the operation after the pilot hole has been displaced. According to the present invention, therefore, the pilot pin is allowed to be inserted into the pilot hole even after the pilot hole is displaced. Specifically, the strip material is stamped while bringing the pilot pin into contact with the inner edge of the pilot hole at the operation before the pilot hole is displaced, and at the operation after the pilot hole is displaced. For this reason, the strip material may be positioned even during execution of the operations in which the pilot hole is being displaced. That is, the strip material may be positioned all through the operations using only the pilot hole formed in the initial phase of the stamping operations.

In addition, after compressing the strip material to partially depress the strip material, or after shearing the strip material to pierce the strip material, the strip material is positioned by bringing the plug arranged in the press machine into contact with a side wall of a recess formed by compressing the strip material, or bringing the plug into contact with an inner edge of a through hole formed by piercing the strip material. That is, the plug assists the positioning of the strip material during operations in which the pilot hole is being displaced, and hence the strip material may be processed accurately.

Further, according to the present invention, the press machine comprises the buffer member to absorb the pushing force of the plug toward a bottom of the recess. Therefore, the bottom of the recess will not be deformed and ruptured by the pushing force of the plug fitted into the recess.

DESCRIPTION OF EMBODIMENT(S)

According to the present invention, the plate member is formed of metal strip material of aluminum alloy. For example, the plate member may be used as a sealing plate to close an open box-shaped case body of a battery case holding a positive plate, a negative plate, a separator, an electrolyte etc., in a liquid-tight manner. In the plate member of this kind, a rib is formed to enhance rigidity of the plate member, and a through hole to attach a predetermined member to the plate member. In a case of adopting the plate member as the above-mentioned sealing plate, a safety valve and a through hole are formed in the plate member. Specifically, the safety valve is ruptured when an internal pressure of the battery case is raised to a predetermined level to release gas from the battery case, and an electrode terminal is attached to the plate member through the through hole.

According to the present invention, the plate members are manufactured sequentially by processing a strip of metallic material into a desired shape by stamping the strip, and thereafter shearing the strip. Specifically, the strip uncoiling from a coil is fed at a given pitch to a press machine in which a progressive stamping die having a plurality of stations is placed, and the strip is drawn and stamped at each of the stations of the die. Consequently, the strip is deformed gradually to be shaped into a plurality of the plate members.

According to the above-explained progressive stamping method, for example, the strip is fed at a given pitch by winding one end of the strip onto a roller. In order to fix a position of the strip with respect to the die, pilot holes are pierced in the strip at a given pitch, and pilot pins to be inserted individually into the pilot holes are formed on each of the stations of the die. Specifically, in order to stamp the strip, the pilot pins formed on one of the upper die and the lower die are inserted into the pilot holes formed on the strip situated between the upper die and the lower die so that the position of the strip with respect to the dies is fixed.

Figure 1:
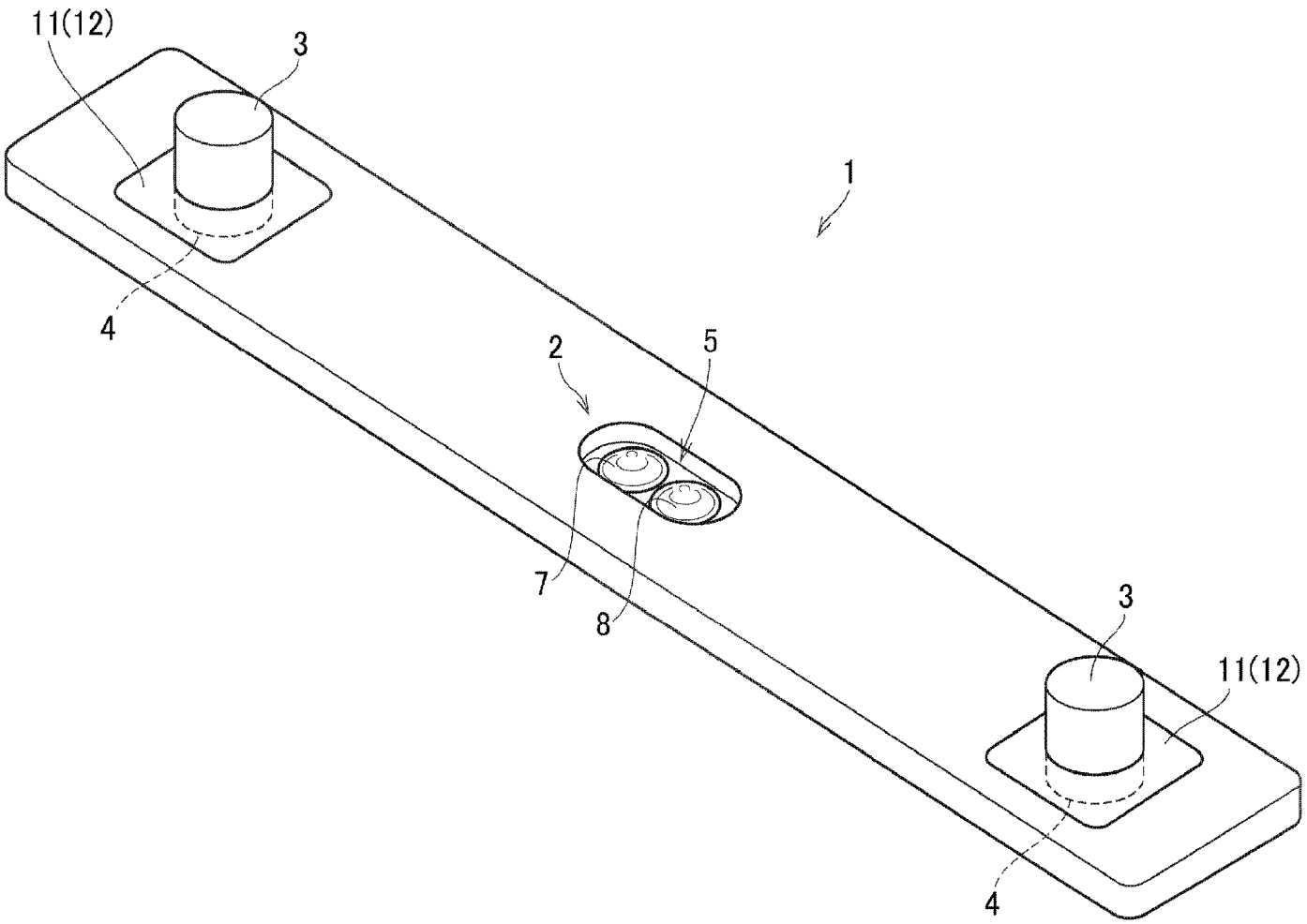
FIG. 1 is a perspective view showing one example of a sealing plate manufactured by the manufacturing method according to the present invention is applied.

FIG. 1 is a perspective view showing one example of a plate member manufactured by the manufacturing method according to the present invention. The plate member shown in FIG. 1 is a sealing plate 1 that is attached to an opening of a not shown open box-shaped case body of a battery case by a laser beam so as to close the battery case liquid-tightly. A recess 2 at which a thickness is thinner, and a pair of through holes 4 are formed in the sealing plate 1, and an electrode terminal 3 is fitted into each of the through holes 4. The recess 2 is formed at an intersection of a longitudinal center and a lateral center of the sealing plate 1, and a safety valve 5 is formed in the recess 2.

Figure 2:
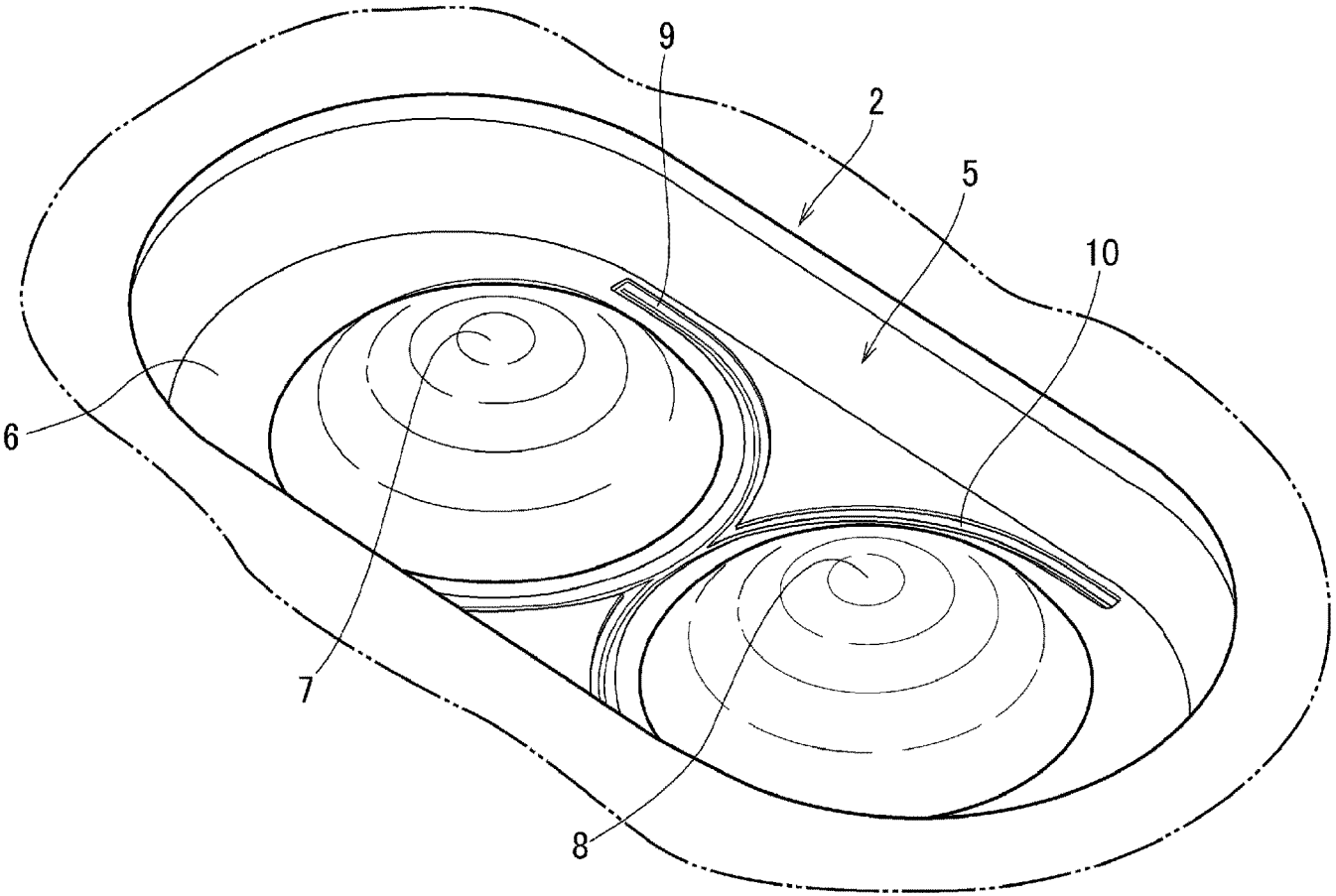
FIG. 2 is a partial enlarged view showing one example of a structure of a safety valve.

Here will be briefly explained one example of the safety valve 5. FIG. 2 is a partial enlarged view showing one example of a structure of the safety valve 5. As illustrated in FIG. 2, the recess 2 has an oval (ellipsoidal) profile which is longer in the longitudinal direction. A thickness of a bottom (to be referred to as thin plate section hereinafter) 6 of the recess 2 is thinner than the other section so that the thin plate section 6 will be ruptured when an internal pressure of the battery case is raised abnormally. Specifically, the thin plate section 6 is formed by applying a compressive load to the strip. In the thin plate section 6, a domed first valve section 7 and a domed second valve section 8 adjacent to each other are formed by partially projecting the thin plate section 6 upwardly. In addition, a first groove 9 is formed around a (substantial) semiperimeter of the first valve section 7 adjacent to the second valve section 8, and a second groove 10 is formed around a (substantial) semiperimeter of the second valve section 8 adjacent to the first valve section 7. Specifically, the first groove 9 and the second groove 10 intersects with each other at a lateral center of the recess 2 (or the sealing plate 1).

In the sealing plate 1 thus structured, when the internal pressure of the battery case is raised abnormally, the grooves 9 and 10 at which the strength is weakest will be ruptured so that the valve sections 7 and 8 will be opened from the center of the recess 2 to isolate away from each other. That is, the valve sections 7 and 8 serve as the safety valve 5.

Each of the electrode terminals 3 individually penetrates through the sealing plate 1 from inside to be exposed to the outside of the sealing plate 1. In order to insulate the electrode terminal 3 from the sealing plate 1, the electrode terminal 3 is fixed to the sealing plate 1 by covering a part of the electrode terminal 3 with an insulating member 11 having a large electrical resistance such as a rubber. To this end, a recess 12 is formed around the through hole 4, and the electrode terminal 3 projecting from the through hole 4 is covered with the insulating member 11 in the recess 12.

The recess 2, the thin plate section 6 (including the valve sections 7 and 8 and the grooves 9 and 10), the through holes 4, and the recesses 12 are formed by stamping the sealing plate 1. Specifically, the above-mentioned sections are formed by drawing, compressing, and shearing the uncoiled strip by the progressive stamping method.

Figure 3:
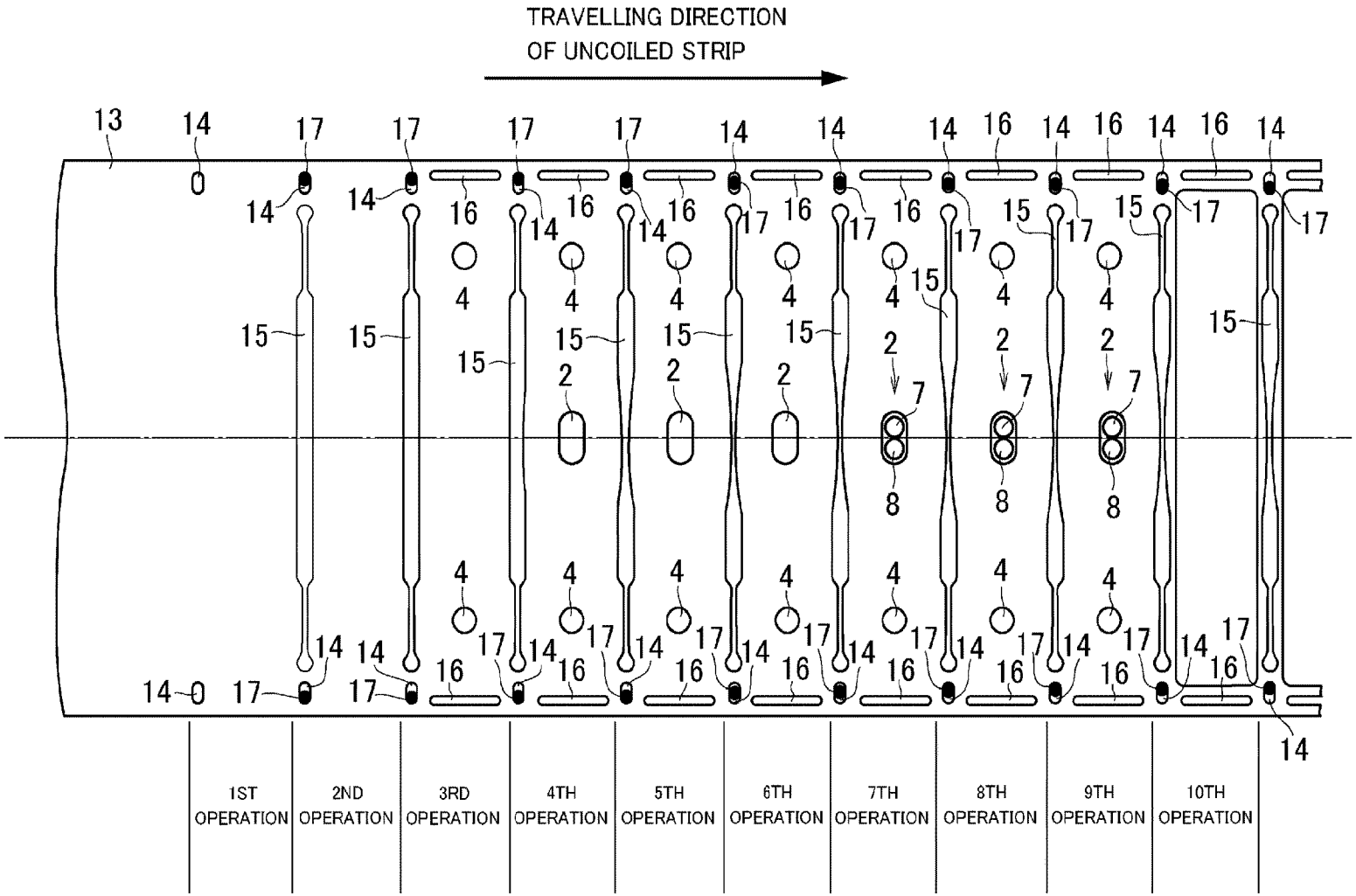
FIG. 3 is a top view of an uncoiled strip showing operations to process the uncoiled strip.

Turning to FIG. 3, there is shown one example of a manufacturing method of the sealing plate 1 from the uncoiled strip. In the example shown in FIG. 3, the uncoiled strip 13 is fed at a given pitch from the left side to the right side in FIG. 3, and the above-mentioned recess 2 and so on are formed at desired sites on the uncoiled strip 13 in the longitudinal direction by a not shown die.

According to the example shown in FIG. 3, the recess 2, the safety valve 5, and the through holes 4 to which the electrode terminals 3 are inserted are formed on the sealing plate 1 by the progressive stamping method. Hereinafter, operations for processing the uncoiled strip 13 will be explained in detail. At the first operation, oval pilot holes 14 are pierced on both lateral ends of the uncoiled strip 13. Then, at the second operation, a lateral slit 15 having a predetermined length in the lateral direction of the uncoiled strip 13 is pierced. Specifically, the lateral slit 15 is formed to absorb an expansion of the uncoiled strip 13 in a travelling direction of the uncoiled strip 13 resulting from an after-mentioned compressing process. To this end, an expansion of the uncoiled strip 13 as might be caused by the compressing process is found in advance by conducting a test stamping, and a size and a configuration of the lateral slit 15 is determined to create a clearance sufficient to absorb the expansion of the uncoiled strip 13. In the example shown in FIG. 3, the lateral slit 15 is formed between the pilot holes 14. However, the lateral slit 15 is not necessarily aligned with the pilot holes 14.

At the third operation, the through holes 4 to which the electrode terminals 3 are inserted and longitudinal slits 16 are pierced in the uncoiled strip 13. As described, the electrode terminals 3 are attached to the longitudinal center of the sealing plate 1. Therefore, at the third operation, the through holes 4 are formed substantially in the middle betweem the preceding lateral slit 15 and the following lateral slit 15. Whereas, the longitudinal slits 16 are formed on both lateral ends of the uncoiled strip 13 between the preceding lateral slit 15 and the following lateral slit 15. Specifically, as the lateral slit 15, the longitudinal slits 16 are formed to absorb an expansion of the uncoiled strip 13 in the lateral direction of the uncoiled strip 13 resulting from the after-mentioned compressing process. To this end, an expansion of the uncoiled strip 13 in the lateral direction as might be caused by the compressing process is also found in advance by the test stamping, and a size and a configuration of the longitudinal slit 16 is determined to create a clearance sufficient to absorb the expansion of the uncoiled strip 13.

At the fourth to sixth operations, the recess 2 is formed by compressing the uncoiled strip 13. Specifically, the recess 2 is formed by compressing the lateral center of the uncoiled strip 13 in the middle between the preceding lateral slit 15 and the following lateral slit 15 by an oval punch. In this example, the recess 2 is formed by gradually reducing a thickness of the uncoiled strip 13 from the fourth operation to the sixth operation. Such compressing process is also referred to as a hammering process or an embossing process.

At the seventh operation, the first valve section 7 and the second valve section 8 are formed within the recess 2. To this end, a lower die having bulging sections to shape the first valve section 7 and the second valve section 8 into desired shapes, and an upper die having depressions to shape the first valve section 7 and the second valve section 8 into desired shapes are used in the seventh operation. Specifically, the thin plate section 6 as a bottom of the recess 2 is placed on the lower die and stamped by the upper die. Consequently, the thin plate section 6 is partially bulged upwardly to form the first valve section 7 and the second valve section 8, or a portion of the thin plate section 6 other than the first valve section 7 and the second valve section 8 is further depressed.

At the eighth and nineth operations, the grooves 9 and 10 are formed. Specifically, as illustrated in FIG. 2, each of the first groove 9 and the second groove 10 individually includes a shallower groove depressed from the thin plate section 6, and a deeper groove extending along a width center of the shallower groove and depressed from the shallower groove. In the example shown in FIG. 3, therefore, the shallower grooves are formed at the eighth operation, and the deeper grooves are formed at the ninth operation by pressing the shallower groove. Thereafter, at the tenth operation, the sealing plate 1 is cut out of the uncoiled strip 13 by shearing the uncoiled strip 13 along a periphery of the sealing plate 1.

Thus, as illustrated in FIG. 3, the uncoiled strip 13 is fed at a given pitch thereby moving the sections to be processed sequentially to the stations performing the first to tenth operations. As described, the pilot holes 14 are pierced at the first operation so that the pilot holes 14 are formed in the uncoiled strip 13 at given intervals in the travelling direction of the uncoiled strip 13. Whereas, pilot pins 17, which are to be inserted into the respective pilot holes 14, are also formed on each station of one of the upper die and the lower die at given intervals in the travelling direction of the uncoiled strip 13.

As also described, the uncoiled strip 13 is compressed at the fourth to sixth operations to reduce the thickness thereof. Consequently, even though the lateral slit 15 and the longitudinal slits 16 have been formed, the pilot holes 14 are displaced slightly. Therefore, a displacement (or migration) of the pilot hole 14 as might be caused by the stamping operation is obtained in advance by conducting a test stamping to form the lateral slit 15, the through holes 4, the longitudinal slits 16, and the recess 2 in the uncoiled strip 13, and each of the pilot holes 14 is pierced into an oval shape so that the uncoiled strip 13 is positioned by the pilot pins 17 even if the pilot holes 14 are displaced.

Figure 4:
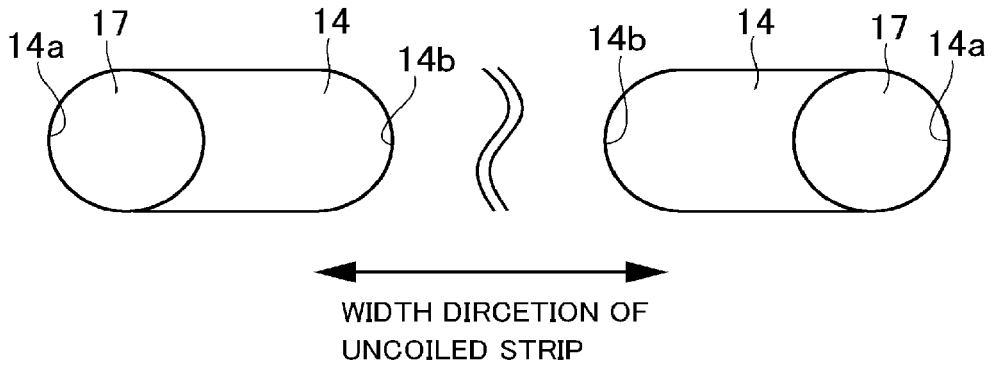
FIG. 4 is a schematic illustration showing a positional relationship between a pilot hole and a pilot pin before the uncoiled strip is expanded (or before a plastic flow of material is caused).
Figure 5:
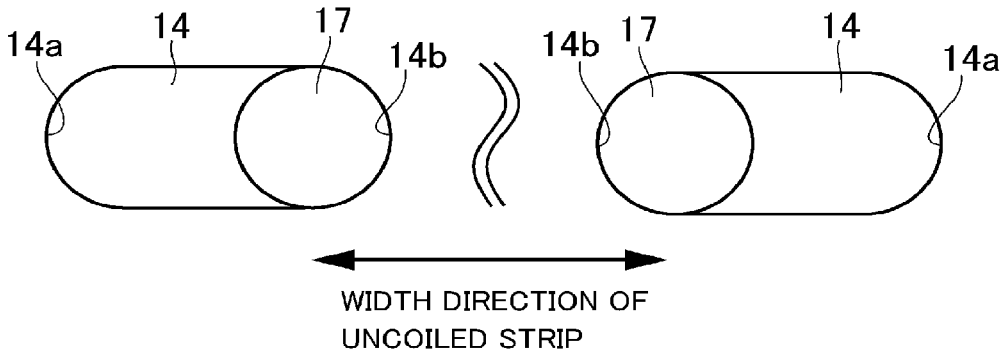
FIG. 5 is a schematic illustration showing a positional relationship between a pilot hole and a pilot pin after the uncoiled strip is expanded (or after the plastic flow of material is caused).

Specifically, each of the pilot holes 14 is shaped such that an outer circumferential surface of the pilot pin 17 comes into contact with an outer arcuate edge 14*a* of the pilot hole 14 located at a laterally outer side of the uncoiled strip 13 during execution of the second and third operations as illustrated in FIG. 4, and that the outer circumferential surface of the pilot pin 17 comes into contact with an inner arcuate edge 14*b* of the pilot hole 14 located at a laterally inner side of the uncoiled strip 13 during execution of the seventh to tenth operations after forming the recess 2 as illustrated in FIG. 5. At the site where the pilot hole 14 is pierced, a plastic flow of the material of the uncoiled strip 13 in its travelling direction resulting from forming the recess 2 is rather small, and each distance between the recess 2 and the pilot hole 14 is relatively long. Therefore, the pilot holes 14 will not be displaced significantly in the travelling direction of the uncoiled strip 13, and widths of the pilot holes 14 will not be reduced significantly. For these reasons, each of the pilot pins 17 is in contact with the inner edge of the pilot hole 14 throughout the operations so that a position of the uncoiled strip 13 is fixed in the travelling direction.

As described, the displacement of the pilot hole 14 as might be caused by the compressing operations is obtained in advance by conducting a test stamping. Based on the displacement obtained from the test stamping, the pilot hole 14 is shaped such that the pilot pin 17 comes into contact with the outer arcuate edge 14*a* of the pilot hole 14 before the pilot hole 14 is displaced, and that the pilot pin 17 comes into contact with the inner arcuate edge 14*b* of the pilot hole 14 after being displaced. By thus shaping the pilot holes 14, the uncoiled strip 13 may be positioned in the width direction not only on the stations at which the operations before the pilot holes 14 are displaced are performed, but also on the stations at which the operations after the pilot holes 14 have been displaced are performed. In other words, although the pilot pin 17 is not in contact with any of the outer arcuate edge 14*a* and the inner arcuate edge 14*b* of the pilot hole 14 during the operation in which the pilot hole 14 is being displaced, the uncoiled strip 13 may be positioned in the width direction before and after the operation in which the pilot hole 14 is being displaced. Therefore, by forming the pilot hole 14 in the above-explained manner, the uncoiled strip 13 may be positioned by the pilot hole 14 formed at the first operation, even if the pilot hole 14 is displaced due to the plastic flow of the material during the process of the progressive stamping.

Figure 6:
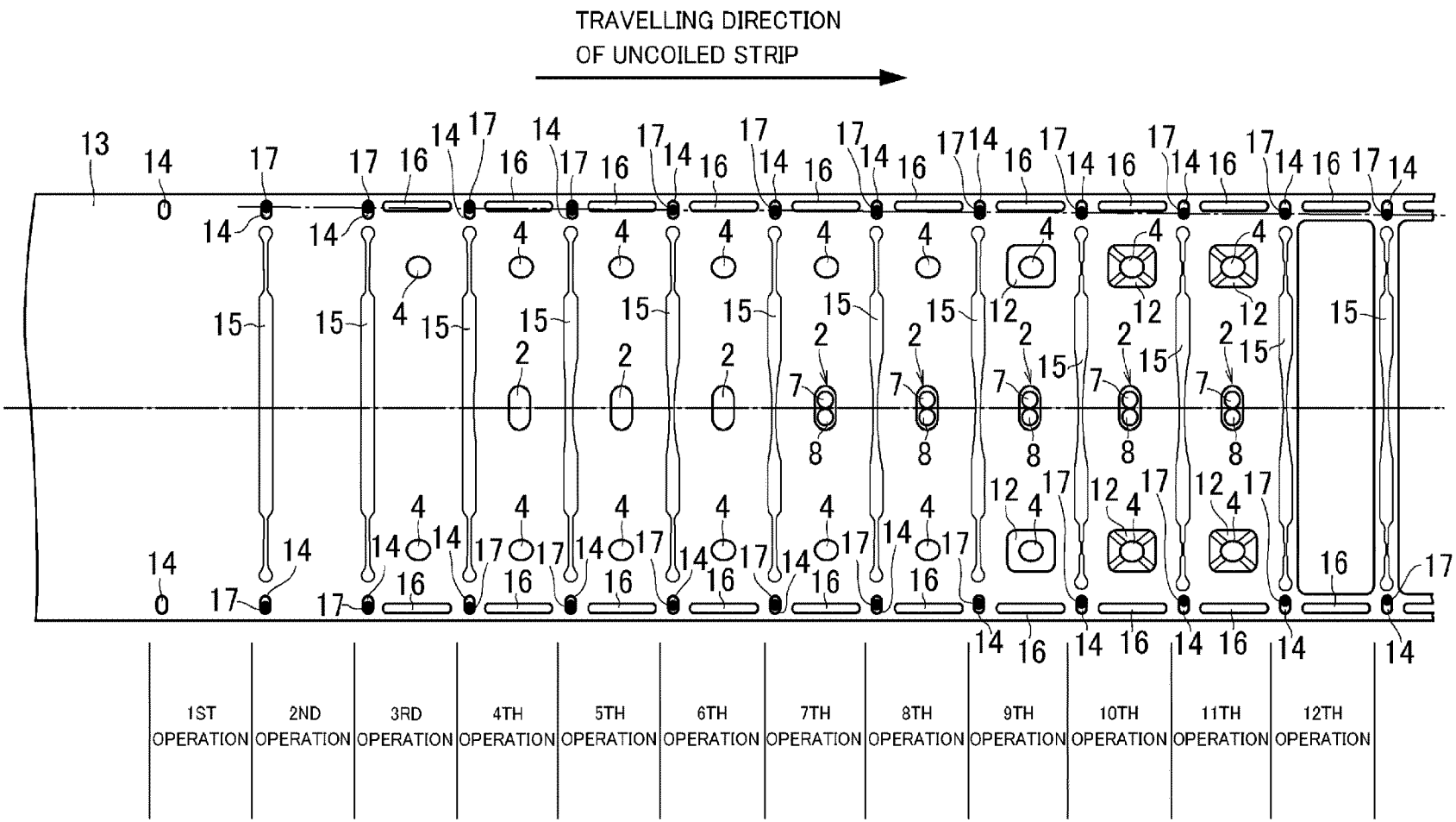
FIG. 6 is a top view of the uncoiled strip showing operations to form a recess in which a safety valve and an insulating member are arranged on the uncoiled strip.

Turning to FIG. 6, there is shown an example of forming the recesses 12 in which the insulating member 11 is arranged by compressing the uncoiled strip 13 in addition to the grooves 9 and 10 at the nineth operation, and further compressing the uncoiled strip 13 to reduce thicknesses of the recesses 12 and to lower the recesses 12 at the tenth and eleventh operations. In the example shown in FIG. 6, the first to eighth operations are identical to the first to eighth operations in the example shown in FIG. 3, and the twelfth operation is identical to the tenth operation in the example shown in FIG. 3.

In the case of forming the recesses 12 after forming the recess 2 as illustrated in FIG. 6, each of the pilot holes 14 is shaped such that each of the pilot pins 17 comes into contact with the outer arcuate edge 14*a* of the pilot hole 14 during execution of the second and third operations before forming the recess 2, and that each of the pilot pins 17 comes into contact with the inner arcuate edge 14*b* of the pilot hole 14 during execution of the twelfth operation after forming the recess 12. That is, the pilot pins 17 do not come into contact with the pilot holes 14 in the width direction of the uncoiled strip 13 during the forming operations of the recesses 12, and hence the uncoiled strip 13 may not be positioned accurately in the width direction.

Therefore, in order to form the recesses 12 accurately, it is preferable to use a die having a plug to be fitted into the recess 2 formed on the sealing plate 1 so as to fix a position of the uncoiled strip 13 with respect to the die, in addition to fix the position of the uncoiled strip 13 by the pilot pins 17 inserted into the pilot holes 14. Instead, a through hole may also be pierced in the uncoiled strip 13. In this case, a projection or a plug to be contacted with an inner edge of the through hole may be formed in the die to fix a position of the uncoiled strip 13.

Figure 7:
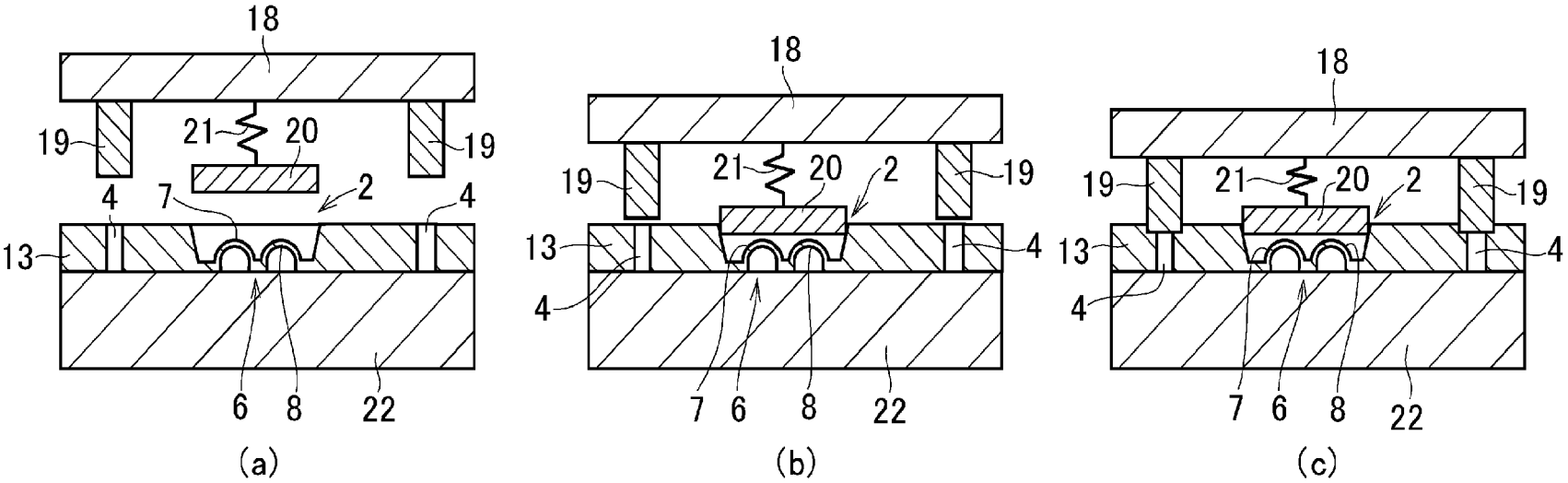
FIG. 7 is a cross-sectional view showing an example of positioning the uncoiled strip by fitting a plug into the recess.

Turning to FIG. 7, there is shown an example of positioning the uncoiled strip 13 by fitting a plug of the die into the recess 2 during execution of the operation to form the recesses 12. FIG. 7 (*a*) shows a situation in which a portion of the uncoiled strip 13 on which the recesses 12 are formed reaches the station at which the nineth operation takes place. As illustrated in FIG. 7 (*a*), an upper die 18 comprises punches 19 that forms the recesses 12, and a plug 20 that is fitted into the recess 2. In order to fix the position of the uncoiled strip 13, the plug 20 is fitted into the recess 2 while being contacted with side walls of the recess 2. Since the recess 2 has been formed by stamping (or compressing) the uncoiled strip 13, the side walls of the recess 2 are slightly inclined. Therefore, side walls of the plug 20 may be inclined to be contacted with the inclined walls of the recess 2.

In addition, in order not to rupture the safety valve 5 by an excessive load when fitting the plug 20 into the recess 2, and in order not to deform the recess 2 when fitting the plug 20 into the recess 2, the upper die 18 further comprises a buffer member that absorbs a load applied to the recess 2 by the plug 20 coming into contact with the recess 2. For example, a cushion whose elastic coefficient is relatively small may be attached to an end face of the plug 20 opposed to a bottom surface of the recess 2 to serve as the buffer member. Instead, a spring whose elastic coefficient is relatively small may be arranged between the plug 20 and the upper die 18 to serve as the buffer member. In the example shown in FIG. 7, a spring 21 is arranged between the plug 20 and the upper die 18 to serve as the buffer member. In addition, when moving the upper die 18 downwardly, it is necessary to fit the plug 20 into the recess 2 before the punches 19 comes into contact to the uncoiled strip 13. In the example shown in FIG. 7, therefore, the plug 20 is situated lower than a lower end of the punch 19.

As illustrated in FIG. 7 (*b*), the plug 20 is fitted into the recess 2 by moving the upper die 18 downwardly. Eventually, the punches 19 comes into contact with the uncoiled strip 13 as illustrated in in FIG. 7 (*c*). Consequently, the uncoiled strip 13 is compressed by the punches 19 on a lower die 22, and the recesses 12 are formed.

Thus, during the operations to form the recesses 12, the pilot pins 17 do not come into contact with any of the outer arcuate edge 14*a* and the inner arcuate edge 14*b* of the pilot hole 14. In this situation, the plug 20 is fitted into the recess 2 thereby assisting the positioning of the uncoiled strip 13. Therefore, the recesses 12 may be formed accurately on the uncoiled strip 13. In addition, since the upper die 18 has the buffer member (i.e., the spring 21), a pushing force of the plug 20 applied to the bottom of the recess 2 can be absorbed. Therefore, the bottom of the recess 2 (including the valve sections 7 and 8) will not be deformed and the safety valve 5 will not be ruptured by the pushing force of the plug 20 fitted into the recess 2.

As described, according to the present invention, a displacement of the pilot hole in the uncoiled strip to be processed is obtained by conducting a test stamping in advance, and a shape of the pilot hole is determined based on the obtained displacement. Instead, positions of the pilot pins in each of the stations of the die in the width direction of the uncoiled strip may also be adjusted based on the displacement of the pilot hole obtained by the test stamping, so as to allow the pilot pins to be inserted into the pilot holes at the operations after the pilot holes are displaced.

Here, a direction of the displacement of the pilot hole varies depending on shapes of the longitudinal slit and the lateral slit, and location of the portions of the uncoiled strip to be compressed. That is, the pilot hole would also be displaced in directions other than the width direction of the uncoiled strip (13). According to the present invention, therefore, the pilot hole may also be inclined with respect to the travelling direction of the uncoiled strip, instead of forming the pilot hole to have a predetermined length in the width direction of the uncoiled strip. For example, the pilot hole may also be shaped into a rectangular shape instead of an oval shape. That is, a shape of the pilot holes may be altered arbitrarily as long as the pilot hole has a wall surface to which the pilot pin is contacted to fix a position of the uncoiled strip during the operations before the pilot hole is displaced, and another wall surface to which the pilot pin is contacted to fix a position of the uncoiled strip during the operations after the pilot hole is displaced.

The invention claimed is:

1. A method of manufacturing plate members sequentially by feeding a strip material at a given pitch to a press machine in which a progressive stamping die having a plurality of stations is placed, and stamping the strip material at each of the stations of the die, comprising:

obtaining a displacement of a pilot hole pierced in the strip material caused by the stamping of the strip material;

determining a shape of the pilot hole or a position of a pilot pin of the die such that the pilot pin is inserted into the pilot hole after being displaced while being brought into contact with an inner edge of the displaced pilot hole;

piercing the pilot hole having the determined shape in the strip material, or adjusting the position of the pilot pin to the determined position; and stamping the strip material by a plurality of operations while bringing the pilot pin into contact with the inner edge of the pilot hole at an operation of the plurality of operations before the pilot hole is displaced, and at an operation of the plurality of operations after the pilot hole is displaced, wherein at least one of the operations of the plurality of operations includes a compressing operation to depress the strip material, or a shearing operation to pierce a desired portion of the strip material, and the strip material is positioned by bringing a plug arranged in the press machine into contact with a side wall of a recess formed by the compressing operation, or bringing the plug into contact with an inner edge of a through hole formed by the shearing operation.

2. The method of manufacturing the plate members as claimed in claim 1, wherein the displacement of the pilot hole is obtained by the stamping of the strip material by the plurality of operations in advance.

3. The method of manufacturing the plate members as claimed in claim 1, wherein the press machine comprises a buffer member that absorbs a pushing force of the plug toward a bottom of the recess.

4. The method of manufacturing the plate members as claimed in claim 3, wherein the buffer member is attached to an end face of the plug opposed to the bottom of the recess.

5. The method of manufacturing the plate members as claimed in claim 3, wherein the buffer member is arranged between the plug and any of an upper die and a lower die between which the strip material is interposed.

6. A method of manufacturing plate members sequentially by feeding a strip material at a given pitch to a press machine in which a progressive stamping die having a plurality of stations is placed, and stamping the strip material at each of the stations of the die, comprising:

obtaining a displacement of a pilot hole pierced in the strip material caused by the stamping of the strip material;

determining a shape of the pilot hole or a position of a pilot pin of the die such that the pilot pin is inserted into the pilot hole after being displaced while being brought into contact with an inner edge of the displaced pilot hole;

piercing the pilot hole having the determined shape in the strip material, or adjusting the position of the pilot pin to the determined position; and stamping the strip material by a plurality of operations while bringing the pilot pin into contact with the inner edge of the pilot hole at an operation of the plurality of operations before the pilot hole is displaced, and at an operation of the plurality of operations after the pilot hole is displaced, wherein the displacement of the pilot hole is obtained by the stamping of the strip material by the plurality of operations in advance, wherein at least one of the operations of the plurality of operations includes a compressing operation to depress the strip material, or a shearing operation to pierce a desired portion of the strip material, and the strip material is positioned by bringing a plug arranged in the press machine into contact with a side wall of a recess formed by the compressing operation, or bringing the plug into contact with an inner edge of a through hole formed by the shearing operation.

7. The method of manufacturing the plate members as claimed in claim 6, wherein the press machine comprises a buffer member that absorbs a pushing force of the plug toward a bottom of the recess.

8. The method of manufacturing the plate members as claimed in claim 7, wherein the buffer member is attached to an end face of the plug opposed to the bottom of the recess.

9. The method of manufacturing the plate members as claimed in claim 7, wherein the buffer member is arranged between the plug and any of an upper die and a lower die between which the strip material is interposed.

* * * * *